US008905195B2

(12) United States Patent
Finschi

(10) Patent No.: US 8,905,195 B2
(45) Date of Patent: Dec. 9, 2014

(54) ELEVATOR SYSTEM CONTROL USING TRAFFIC OR PASSENGER PARAMETERS

(75) Inventor: Lukas Finschi, Ebikon (CH)

(73) Assignee: Inventio AG, Hergiswil NW (CH)

( * ) Notice: Subject to any disclaimer, the term of this patent is extended or adjusted under 35 U.S.C. 154(b) by 775 days.

(21) Appl. No.: 13/144,808

(22) PCT Filed: Jan. 15, 2010

(86) PCT No.: PCT/EP2010/000196

§ 371 (c)(1),
(2), (4) Date: Sep. 6, 2011

(87) PCT Pub. No.: WO2010/081709

PCT Pub. Date: Jul. 22, 2010

(65) Prior Publication Data

US 2012/0000733 A1 Jan. 5, 2012

(30) Foreign Application Priority Data

Jan. 16, 2009 (EP) ..... 09150771

(51) Int. Cl.
*B66B 1/18* (2006.01)
*B66B 1/24* (2006.01)

(52) U.S. Cl.
CPC ..... *B66B 1/2458* (2013.01); *B66B 2201/103* (2013.01); *B66B 2201/104* (2013.01); *B66B 2201/211* (2013.01); *B66B 2201/214* (2013.01); *B66B 2201/221* (2013.01); *B66B 2201/222* (2013.01); *B66B 2201/304* (2013.01); *B66B 2201/306* (2013.01); *B66B 2201/401* (2013.01); *B66B 2201/403* (2013.01); *B66B 2201/405* (2013.01); *B66B 2201/4615* (2013.01); *B66B 2201/463* (2013.01); *B66B 2201/4653* (2013.01)
USPC ..... 187/382; 187/392; 187/249

(58) Field of Classification Search
CPC ..... B66B 1/2408; B66B 2201/21; B66B 2201/215; B66B 2201/225; B66B 2201/222; B66B 2201/306
USPC ..... 187/247, 380–388, 391–393, 902, 249
See application file for complete search history.

(56) References Cited

U.S. PATENT DOCUMENTS 5,086,883 A 2/1992 Schroder
5,625,176 A * 4/1997 Davis et al. ..... 187/393

(Continued)

FOREIGN PATENT DOCUMENTS

EP 1970340 9/2008

*Primary Examiner* — Anthony Salata
(74) *Attorney, Agent, or Firm* — Stroock & Stroock & Lavan LLP

(57) ABSTRACT

An elevator system having a double or multiple elevator cabins per elevator shaft can be controlled using a method, wherein at least one destination call is entered or at least one identification code is received on at least one call entry floor, said destination call or identification code designating an arrival floor; wherein at least one trip by at least one elevator cabin of the double or multiple elevator cabin from a departure floor to an arrival floor is determined for the destination call or identification code; wherein before determining a trip, it is determined whether at least one situation-specific parameter is fulfilled; and if said situation-specific parameter is fulfilled, at least one situation-compatible call assignment is determined for a trip having a floor difference of zero between the call entry floor and the departure floor or having a floor difference of zero between the destination floor and the arrival floor.

20 Claims, 5 Drawing Sheets

(56) References Cited

U.S. PATENT DOCUMENTS

| | | | | |
|---|---|---|---|---|
| 5,861,587 | A * | 1/1999 | Powell et al. | 187/382 |
| 6,237,721 | B1 * | 5/2001 | Siikonen | 187/382 |
| 6,293,368 | B1 * | 9/2001 | Ylinen et al. | 187/382 |
| 6,401,874 | B2 * | 6/2002 | Siikonen | 187/382 |
| 6,419,051 | B2 * | 7/2002 | Mori et al. | 187/382 |
| 6,913,117 | B2 * | 7/2005 | Tyni et al. | 187/382 |
| 7,083,027 | B2 * | 8/2006 | Siikonen et al. | 187/383 |
| 7,694,781 | B2 * | 4/2010 | Sorsa et al. | 187/382 |
| 8,387,756 | B2 * | 3/2013 | Laihanen et al. | 187/387 |
| 2008/0067013 | A1 | 3/2008 | Ylinen et al. | |
| 2008/0236956 | A1 | 10/2008 | Finschi | |

* cited by examiner

ELEVATOR SYSTEM CONTROL USING TRAFFIC OR PASSENGER PARAMETERS

FIELD

The disclosure relates to controlling an elevator system.

BACKGROUND

An elevator system traditionally involves a floor call being made, after which an elevator cabin is moved to the floor of the call input. When the passenger has entered the elevator cabin a cabin call for a desired destination floor is made and the elevator cabin is moved to this destination floor. By contrast, a destination call involves the desired destination floor being denoted when the call is actually input, which means that a cabin call is no longer necessary. Hence, the destination call controller also knows the destination floor when the call is actually input, and is therefore able to optimize not only the approach to the call input floor but also that to the destination floor, which can increase the efficiency of the control.

EP1970340A1 relates to an elevator system having elevator cabins which can move independently in the same elevator shaft. In a normal mode, an elevator controller provides only a lower elevator cabin for passengers at a bottommost stop, and accordingly the elevator controller provides only an upper elevator cabin for passengers at a topmost stop in normal mode. If the elevator controller establishes that more destination calls have been received for a bottommost or else topmost stop than the respective elevator cabin is able to convey at the given time, the elevator controller changes to an alternative mode, in which an upper elevator cabin is temporarily also provided for passengers at a bottommost stop, or else in which a lower elevator cabin is temporarily also provided for passengers at a topmost stop. Since these elevator cabins cannot reach the desired bottommost or else topmost stop, the passengers are made aware of this during the journey and need to cover the floor difference using a (moving) staircase.

US2008/0236956A1 shows a method for allocating a passenger to an elevator system having a multiplicity of elevator cabins. The passenger uses a mobile communication unit to send a destination to a destination call controller in the elevator system. The destination call controller ascertains a group of elevator cabins for handling the destination call and notifies the passenger of the group of elevator cabins using the mobile communication unit. The passenger selects an elevator cabin from the group of elevator cabins according to his individual needs and uses the mobile communication unit to notify the destination call controller of the selection.

In this regard, EP0459169A1 discloses a method for controlling an elevator system having double elevator cabins, which double elevator cabins approach adjacent floors of a building simultaneously. Hence, passengers enter and leave the two double elevator cabins simultaneously on adjacent even-numbered and odd-numbered floors, which increases the transportation capacity of the elevator system. This involves the use of a destination call controller with immediate allocation of destination calls. For a destination call, a departure floor is allocated to the passenger on the call input floor. The call input floor and the departure floor may differ by a floor difference. For example, the passenger on a call input floor makes a destination call for a destination floor and is served by a double elevator cabin which departs from a higher or lower departure floor. Alternatively, the destination floor and the arrival floor may differ by a floor difference. Thus, the passenger can make a destination floor call and is moved by a double elevator cabin from the call input floor to an arrival floor which is above or below the destination floor. From a statistical point of view, the passenger has a 50% chance of being moved from the call input floor to the destination floor without a floor change using this method.

SUMMARY

In at least some embodiments, controlling an elevator system having a double or else multiple elevator cabin per elevator shaft involves at least one destination call being input on at least one call input floor; wherein the destination call denotes a destination floor; wherein at least one journey using at least one elevator cabin from the double or else multiple elevator cabin from a departure floor to an arrival floor is ascertained for the destination call; in this case, ascertainment of a journey is preceded by a check to determine whether at least one situation-specific parameter is satisfied; and if a situation-specific parameter is satisfied then at least one situation-compliant call allocation is ascertained for a journey with a floor difference of zero between the call input floor and the departure floor or else with a floor difference of zero between the destination floor and the arrival floor.

This can mean that ascertainment of a journey is preceded by a check of a situation-specific parameter, which allows a journey from the call input floor to the destination floor with a floor difference of zero to be ascertained, so that the passenger does not need to climb stairs or else use a moving staircase or else take detours in order to get to a departure floor or else to an arrival floor. The general purpose of the elevator system is, of course, to convey the passenger not only quickly but also conveniently in the building. In at least some cases, the embodiments avoid less-than-optimum journeys. Whereas, in some cases, a high volume of traffic allows the convenience for the individual passenger to be improved only with a disproportionately large concession as regards the service costs for all the passengers, low and average traffic volume, in some cases, makes it possible to make a situation-compliant call allocation for a journey from the call input floor to the destination floor with a floor difference of zero.

By taking account of the specific situation in the elevator system, less-than-optimum journeys can be avoided and the passenger's expectation of the performance of the elevator system can be met.

In some cases, the situation-specific parameter used is at least one instantaneous volume of traffic in the elevator system or else of at least one elevator cabin or else at least one instantaneous time of day or else at least one instantaneous day of the week or else at least one instantaneous route distance for a passenger to at least one elevator cabin.

This can mean that a situation-specific parameter is set which can be checked easily and separately from the ascertainment of a journey, which can save computation power.

In some cases, if a situation-specific parameter is not satisfied then at least one favorable call allocation is ascertained for a journey with a floor difference other than zero between the call input floor and the departure floor or else with a floor difference other than zero between the destination floor and the arrival floor.

This can mean that if the situation in the elevator system does not so permit, a most favorable call allocation is ascertained for a journey with a floor difference other than zero.

In some cases, ascertainment of a journey is preceded by a check to determine whether at least one passenger benefit exists, and if a passenger benefit does exist then at least one passenger-beneficial caller allocation is ascertained for a journey with passenger benefit.

This can mean that a passenger benefit is taken into account for the call allocation. This involves ascertainment of a journey being preceded by a check to determine whether a passenger benefit exists.

In some cases, the passenger benefit used is at least one waiting time or else at least one destination time or else at least one number of changes of direction or else at least one number of changes by the passenger or else at least one number of intermediate stops or else at least one elevator cabin passenger number or else at least one route distance or else at least one route passenger number or else at least one elevator cabin equipment.

This can mean that diverse and different passenger benefits can be specifically taken into account for the ascertainment of a passenger-beneficial call allocation.

In some cases, ascertainment of a journey is preceded by a check to determine whether at least one passenger benefit exists, and if a situation-specific parameter is not satisfied but a passenger benefit exists then at least one passenger-beneficial call allocation is ascertained for a journey with passenger benefit.

This can mean that if a situation-specific parameter is not satisfied then at least one passenger benefit is taken into account for the call allocation.

In some cases, ascertainment of a journey is preceded by a check to determine whether at least one passenger benefit exists, and if a situation-specific parameter is not satisfied and a passenger benefit does not exist then at least one most favorable call allocation is ascertained for a journey with a floor difference other than zero between the call input floor and the departure floor or else with a floor difference other than zero between the destination floor and the arrival floor.

This can mean that if the situation in the elevator system does not so permit and also no passenger benefit exists, a most favorable call allocation is ascertained for a journey with a floor difference other than zero.

In some cases, the destination call is input on at least one call input apparatus or else on at least one mobile appliance. In some cases, the destination call is input with at least one user code on at least one call input apparatus or else on at least one mobile appliance.

This can mean that the passenger can input a destination call either on a fixed call input device in the elevator system or on a mobile appliance, with a high level of flexibility. If a user profile is also intended to be called, the passenger can input a user code in addition to the identification code.

In some cases, the input destination call is transmitted to at least one destination call controller using the address of the call input apparatus on which the destination call was input, or else the input destination call is transmitted to the destination call controller using the address of the mobile appliance on which the destination call was input. In some cases, the input destination call and the input user code are transmitted to at least one destination call controller using the address of the call input apparatus on which the destination call and the user code were input, or else the input destination call and the input user code are transmitted to the destination call controller using the address of the mobile appliance on which the destination call and the user code were input. In some cases, the destination call controller transmits at least one destination call acknowledgement signal to the address of the call input apparatus on which the destination call was input, or else the destination call controller transmits at least one destination call acknowledgement signal to the address of the mobile appliance on which the destination call was input.

This can mean that the passenger obtains feedback from a destination call controller in response to his destination call or else his user code, which feedback is transmitted to the address of the destination call input appliance.

In some cases, at least one mobile appliance sends at least one identification code to at least one call input apparatus or else to at least one destination call controller; the sent identification code is received by the call input apparatus; the received identification code is transmitted from the call input apparatus to the destination call controller; the transmitted identification code is received by the destination call controller; and the destination call controller reads at least one destination call for the received identification code from at least one computer-readable data memory. In some cases, at least one mobile appliance sends at least one identification code to the destination call controller; the sent identification code is received by the destination call controller; and the destination call controller reads at least one destination call for the received identification code from at least one computer-readable data memory.

This can mean that the passenger can also easily send just an identification code. This can be done in passing a fixed call input device or remotely directly to the destination call controller.

In some cases, at least one mobile appliance sends at least one identification code to at least one call input apparatus; the identification code is transmitted from the call input apparatus to the destination call controller using the address of the call input apparatus to which the identification code was sent; the transmitted identification code and the transmitted address of the call input apparatus are received by the destination call controller; and the destination call controller reads at least one destination call for the received identification code from at least one computer-readable data memory. In some cases, at least one mobile appliance sends at least one identification code to the destination call controller; the identification code is sent to the destination call controller using the address of the mobile appliance; the sent identification code and the address of the mobile appliance are received by the destination call controller; and the destination call controller reads at least one destination call for the received identification code from at least one computer-readable data memory.

This can mean that the passenger receives feedback from the destination call controller in response to an identification code, which feedback is transmitted to the address of the identification code transmitting appliance.

In some cases, the destination call controller ascertains at least one call allocation for a journey. In some cases, the destination call controller ascertains at least one situation-compliant call allocation with a floor difference of zero for a journey. In some cases, the destination call controller ascertains at least one most favorable call allocation with a floor difference other than zero for a journey.

This can mean that the destination call controller ascertains a situation-compliant call allocation for a journey with a floor difference equal to zero or a journey with a floor difference other than zero as the most favorable call allocation with the shortest possible waiting time or else the shortest possible destination time, depending on the situation in the elevator system.

In some cases, the destination call controller ascertains at least one passenger-beneficial call allocation with at least one passenger benefit for a journey; and the passenger benefit used is at least one waiting time or else at least one destination time or else at least one number of changes of direction or else at least one number of changes by the passenger or else at least one number of intermediate stops or else at least one elevator cabin passenger number or else at least one route distance or else at least one route passenger number or else at least one elevator cabin equipment.

This can mean that the destination call controller ascertains a passenger-beneficial call allocation with an additional individual passenger benefit, which passenger benefits may be very different, depending on the situation in the elevator system.

In some cases, the destination call controller ascertains at least one passenger-beneficial call allocation with at least one passenger benefit for a journey; wherein a plurality of passenger benefits are put into different rankings and the destination call controller uses at least one highest-ranking passenger benefit.

This can mean that passenger benefits can be weighted individually.

In some cases, at least one call allocation is output as at least one destination call acknowledgement signal on at least one output appliance of the call input apparatus or else on at least one input/output appliance of the mobile appliance. In some cases, at least one multimedia information item is output for the passenger-beneficial call allocation.

This can mean that the passenger receives diverse pieces of useful information as an output from the destination call controller.

In some cases, the check to determine whether at least one situation-specific parameter or else at least one passenger benefit is satisfied is preceded by at least one passenger benefit or else at least one situation-specific parameter being output as a multimedia information item on at least one input/output appliance of at least one call input apparatus or else of at least one mobile appliance.

This can mean that the passenger receives diverse pieces of useful information as an output from the destination call controller before the actual call input.

In some cases, a passenger-beneficial call allocation with an optimum for at least one passenger benefit of weighting time or else destination time or else number of changes of direction or else number of changes by the passenger or else number of intermediate stops or else elevator cabin passenger number or else route distance or else route passenger number or else elevator cabin equipment is output.

This can mean that the passenger receives feedback about his passenger benefit which has actually been obtained.

In some cases, a computer program product comprises at least one computer program means which is suitable for implementing the method for controlling an elevator system by virtue of at least one method step being performed when the computer program means is loaded into the processor of a call input apparatus or else of a mobile appliance or else of a destination call controller.

In some cases, the computer-readable data storage medium comprises such a computer program product.

BRIEF DESCRIPTION OF THE DRAWINGS

The disclosed technologies are explained in detail with reference to the figures, in which.

DETAILED DESCRIPTION

Figure 1:
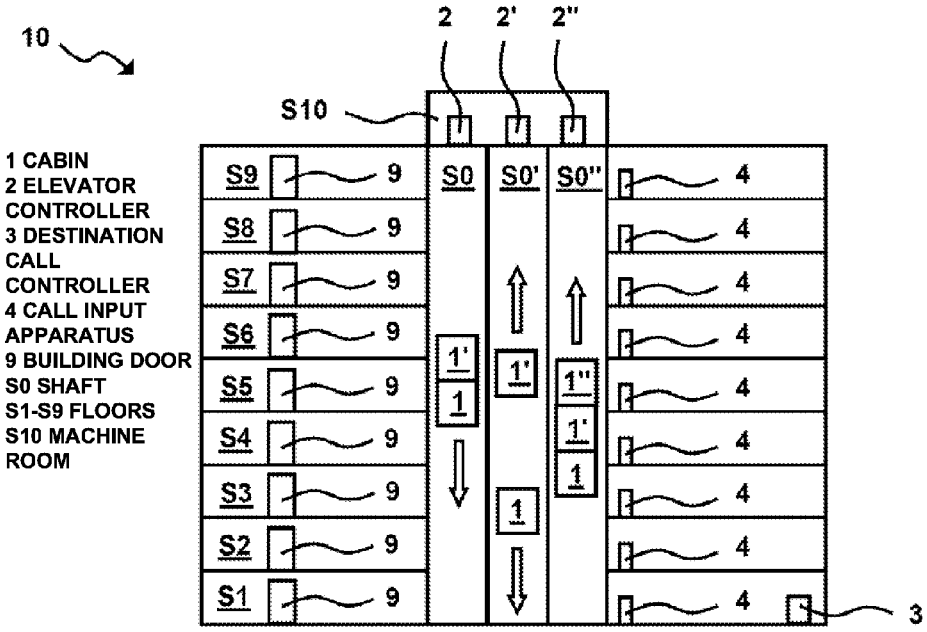
FIG. 1 shows a schematic view of a portion of an exemplary embodiment of an elevator system.

FIG. 1 shows an exemplary embodiment of an elevator system 10 having at least one elevator in a building. Each elevator has a plurality of elevator cabins 1, 1', 1" per elevator shaft S0, S0', S0". The elevator cabins 1, 1', 1" are able to be moved in the elevator shaft S0, S0', S0" singly or as multiple elevator cabins, as indicted by vertical direction arrows. The elevator shaft S0' contains an elevator having a double elevator cabin 1, 1'. The elevator shaft S0' contains an elevator having two elevator cabins 1, 1' which are arranged above one another and which can be moved independently of one another. The elevator shaft S0" contains an elevator having a triple elevator cabin 1, 1', 1". The building has a relatively large number of floors S1 to S9 with building doors 9. By way of example, at least one room or else corridor or else stairwell on each floor S1 to S9 can be reached via a building door 9. On each of the floors S1 to S9, a passenger can enter or else leave an elevator cabin 1, 1', 1" via at least one floor door. At least one machine room S10 contains at least one elevator controller 2, 2', 2" for each elevator. Each elevator controller 2, 2', 2" actuates at least one elevator drive and at least one door drive for the elevator and thus moves the elevator cabin 1, 1', 1" and opens and closes at least the floor door. From at least one shaft information item, each elevator controller 2, 2', 2" receives information about the current position of the elevator cabin 1, 1', 1" in the elevator shaft S0, S0', S0". Each elevator controller 2, 2', 2" has at least one signal bus adapter 28, 28', 28" for at least one signal bus 8, 8', 8". Each subscriber in the communication on the signal bus 8, 8', 8" has an explicit address.

Figure 2:
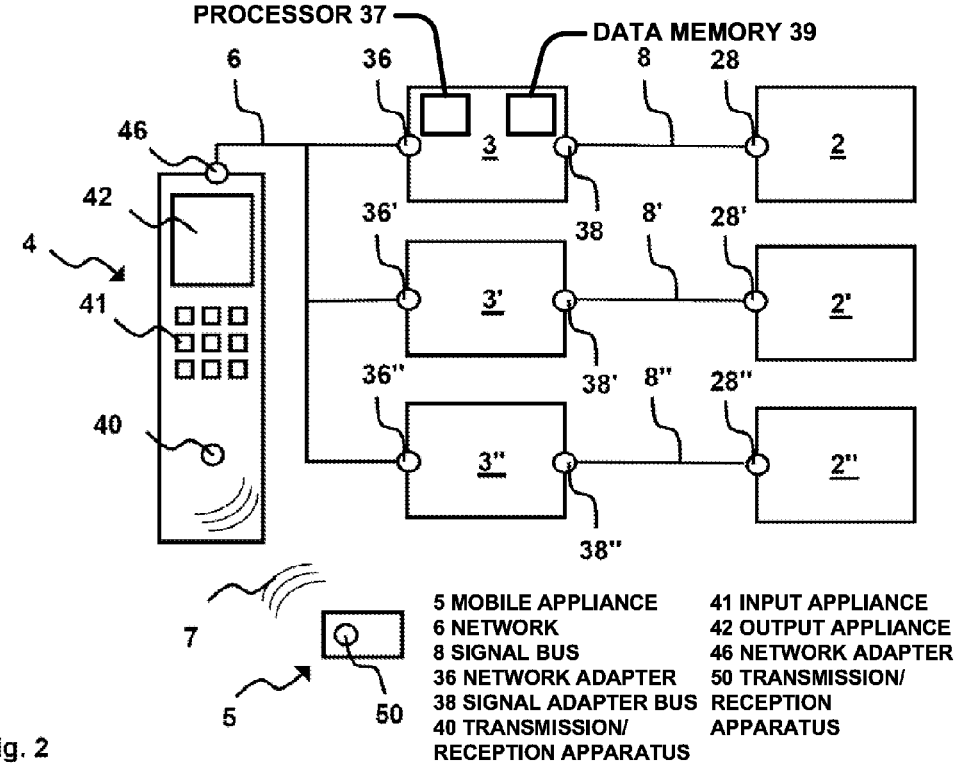
FIG. 2 shows a schematic view of a portion of a first exemplary embodiment of a call input in the elevator system shown in FIG. 1.
Figure 3:
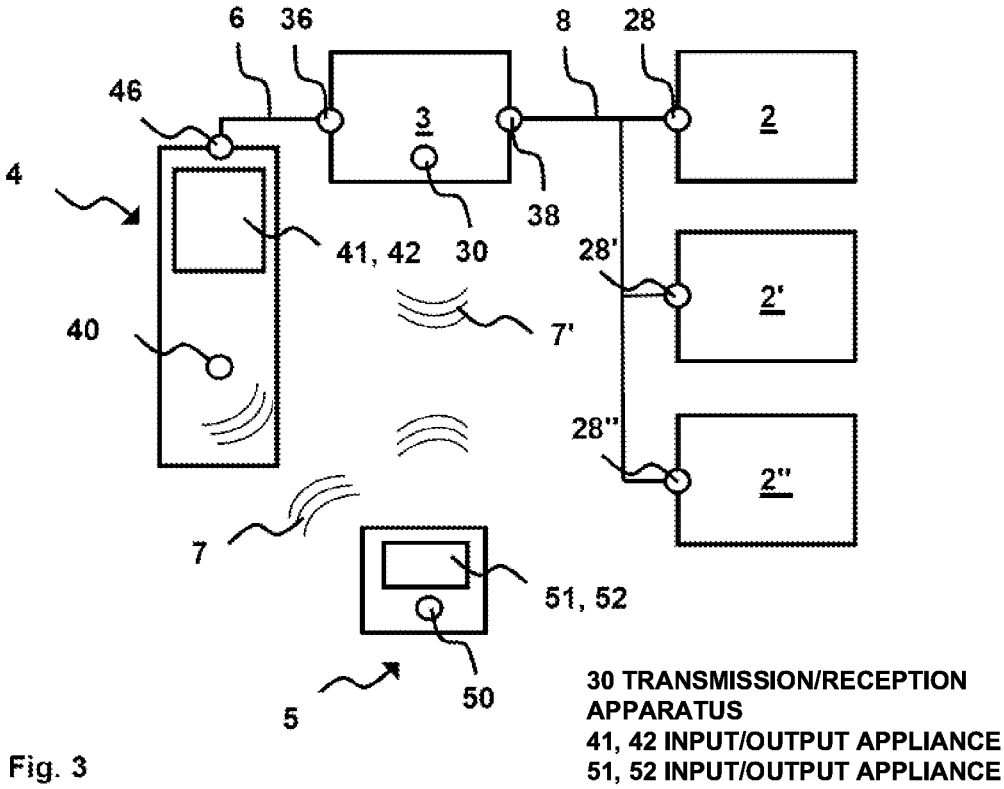
FIG. 3 shows a schematic view of a portion of a second exemplary embodiment of a call input in the elevator system shown in FIG. 1.

FIGS. 2 and 3 show two exemplary embodiments of a call input apparatus 4 for inputting at least one destination call. Each floor S1 to S9 holds at least one call input apparatus 4 at a fixed location close to a floor door. The call input apparatus 4 may be mounted on a building wall or stands isolated in a room in front of the floor door. A housing for the call input apparatus 4 contains at least one transmission/reception apparatus 40 for at least one radio network 7, 7', at least one network adapter 46 for at least one network 6, at least one output appliance 42 and at least one electrical power supply. In addition, the housing of the call input apparatus 4 may contain at least one input appliance 41. The call input apparatus 4 has at least one processor and at least one computer-readable data memory. From the computer-readable data memory, at least one computer program means is loaded into the processor and executed. The computer program means actuates the transmission/reception apparatus 40, the network adapter 46, the input appliance 41 and the output appliance 42.

According to FIG. 2, the call input apparatus 4 has, as input appliance 41, a plurality of keys which the passenger can use to manually input a destination call by means of at least one sequence of numbers. According to FIG. 3, the call input apparatus 4 is keyless, and a destination call is provided contactlessly by virtue of the transmission/reception apparatus 40 reading at least one identification code from at least one computer-readable data memory in at least one mobile appliance 5 carried by the passenger. The output appliance 42 is used to output at least one destination call acknowledgement signal to the passenger. The passenger thus receives a visual or else audible destination call acknowledgement on the output appliance 42. The call input by means of keys and contactless call input can be combined with one another. The passenger can change or else delete the destination call—provided by virtue of the computer-readable data memory being read—on the input appliance 41 of the call input apparatus 4. According to FIG. 3, the input appliance 41 is a touchscreen, which touchscreen is simultaneously also the output appliance 42.

At least one destination call controller 3, 3', 3" has at least one processor 37, at least one computer-readable data memory 39, at least one network adapter 36 for the landline network 6 or else at least one transmission/reception apparatus 30 for the radio network 7, 7', at least one signal bus adapter 38, 38', 38" for the signal bus 8, 8', 8" and at least one electrical power supply. The call input apparatus 4 uses the landline network 6 to transmit an input destination call T1 or else a read identification code T1' to the destination call controller 3, 3', 3". The destination call controller 3, 3', 3" allocates at least one destination call to the identification code T1' or else ascertains at least one journey for a destination call T1. According to FIG. 1, the destination call controller 3, 3, 3" is a standalone electronic unit in a separate housing, said unit being positioned on floor S1, for example. The destination call controller 3, 3', 3" may also be an electronic slide-in module, for example in the form of a printed circuit board, which printed circuit board has been inserted in a housing for an elevator controller 2, 2', 2", as shown in FIG. 2, or else has been inserted in a housing for a call input apparatus 4, as shown in FIG. 3. If the elevator system 10 has a plurality of destination call controllers 3, 3', 3", for example if each elevator controller 2, 2', 2" has an associated destination call controller 3, 3', 3" as shown in FIG. 2, then the destination call controllers 3, 3', 3" communicate with one another via the landline network 6.

A favorable call allocation can denote a journey using at least one elevator cabin 1, 1', 1" from a departure floor to an arrival floor with the shortest possible waiting time or else the shortest possible destination time. The departure floor does not have to correspond to the call input floor. The arrival floor also does not have to correspond to the destination floor as desired by the passenger on the basis of the destination call. When the most favorable call allocation is assigned to the elevator cabin 1, 1', 1", at least one departure call signal and at least one arrival call signal are produced and the signal bus 8, 8', 8" is used to transmit them to the signal bus adapter 28, 28', 28" of the elevator controller 2, 2', 2" for this elevator cabin 1, 1', 1". From the computer-readable data memory in the destination call controller 3, 3', 3", at least one computer program means is loaded into the processor of the destination call controller 3, 3', 3" and executed. The computer program means performs the most favorable call allocation, and the computer program means also produces the departure call signal and the arrival call signal. The computer program means also controls the communication with the elevator controller 2, 2', 2" via the signal bus 8, 8', 8" and the communication with the call input apparatus 4 via the landline network 6. The computer program means of the destination call controller 3, 3', 3" can also be loaded into a processor in a call input apparatus 4 or else in an elevator controller 2, 2', 2" and executed therein. The computer-readable data memory of the destination call controller 3, 3', 3" may also be a computer-readable data memory in a call input apparatus 4 or else in an elevator controller 2, 2', 2".

The mobile appliance 5 is carried by the passenger and is a frequency identification device (RFID) or else a mobile telephone or else a computer having at least one transmission/reception apparatus 50. According to FIGS. 3 and 4, at least one input/output appliance 51, 52 is also arranged in the mobile appliance 5. The input/output appliance 51, 52 is a touchscreen. The input/output appliance 51, 52 is used to output at least one destination call acknowledgement signal to the passenger. The passenger is thus provided with a visual or else audible destination call acknowledgement on the input/output appliance 51, 52.

The call input apparatus 4 or else the mobile appliance 5 or else the destination call controller 3, 3', 3" communicate with one another by landline network 6 or else by radio network 7, 7'. In the case of an RFID the range of the radio network 7, 7' can be limited to between a few centimeters and a few meters. Alternatively, it is possible to use a local area radio network 7, 7' having a range of between several tens of meters and several tens of kilometers, such as Bluetooth based on the IEEE 802.15.1 standard, ZigBee based on the IEEE 802.15.4 standard, wireless local area network (WLAN) based on the IEEE802.11 standard or Worldwide Interoperability for Microwave Access (WIMAX) based on the IEEE802.16 standard.

Both the landline network 6 and the radio network 7, 7' allow bidirectional communication on the basis of known and tried-and-tested network protocols, such as the transmission control protocol/internet protocol (TCP/IP) or Internet packet exchange (IPX). In this case, each subscriber transmits data together with an explicit address for the subscriber to an explicit address for an addressee. The landline network 6 has a plurality of electrical or else optical data cables which are concealed in the building.

According to FIG. 2, the mobile appliance 5 is an RFID having a transmission/reception apparatus 50 in the form of a coil. The coil draws power inductively from the electromagnetic field of the radio network 7 of the transmission/reception apparatus 40 of the call input apparatus 4 and is thus energized. The energization is effected automatically as soon as the RFID is within range of the radio network 7. As soon as the RFID has been energized, the processor reads an identification code T1' stored in the computer-readable data memory, so that the identification code is sent via the coil to the transmission/reception apparatus 40 of the call input apparatus 4. The energization of the RFID and the transmission of the identification code T1' to the call input apparatus 4 are effected contactlessly. The landline network 6 is used by the call input apparatus 4 to transmit the identification code T1' to the destination call controller 3, 3', 3". The destination call controller 3, 3', 3" transmits at least one destination call acknowledgement signal to the call input apparatus 4.

According to FIG. 3, the mobile appliance 5 communicates with the call input apparatus 4 in a first radio network 7, the mobile appliance 5 communicates with the destination call controller 3, 3', 3" in a second radio network 7', while the call input apparatus 4 and the destination call controller 3, 3', 3" communicate with one another in the landline network 6. As soon as the mobile appliance 5 is within range of the first radio network 7, the mobile appliance 5 uses the first radio network 7 to transmit an identification code T1' stored in the computer-readable data memory or else a destination call which has been input via the input/output appliance 51, 52 to the call input apparatus 4. The call input apparatus 4 uses the landline network 6 to transmit the identification code T1' or else the destination call T1 to the destination call controller 3, 3', 3". The destination call controller 3, 3', 3" transmits at least one destination call acknowledgement signal either to the call input apparatus 4 using the landline network 6 or else to the mobile appliance 5 using the second radio network 7'.

Figure 4:
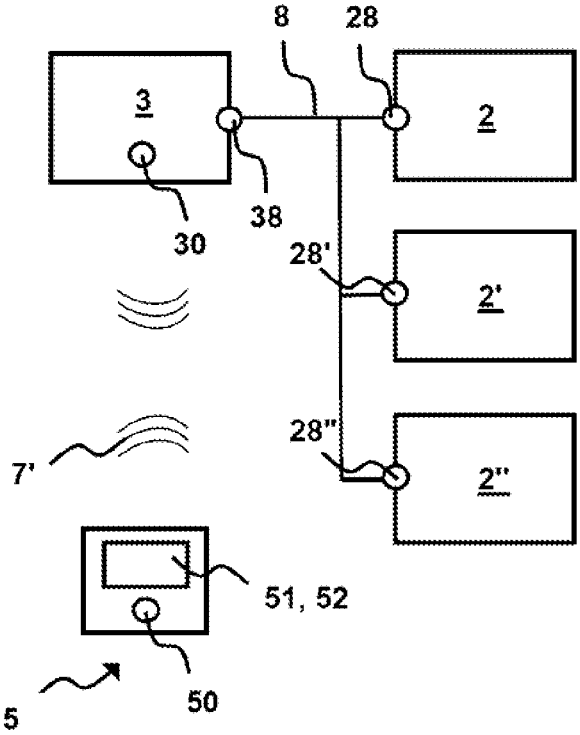
FIG. 4 shows a schematic view of a portion of a third exemplary embodiment of a call input in the elevator system shown in FIG. 1.

In a third exemplary embodiment of the call input of destination calls as shown in FIG. 4, a standalone call input apparatus 4 is not necessary, since the mobile appliance 5 uses the transmission/reception apparatus 50 in the radio network 7 to communicate directly with at least one transmission/reception apparatus 30 integrated in the destination call controller 3, 3', 3". As soon as the mobile appliance 5 is within range of the radio network 7, the passenger can transmit an identification code T1' or else destination call T1 to the destination call controller 3, 3', 3" and receives a transmission containing a destination call acknowledgement signal from the destination call controller 3, 3', 3". By way of example, each floor S1 to S9 holds at least one transmission/reception apparatus 30 for the destination call controller 3, 3', 3", so that a call input floor is allocated to the floor S1 to S9 for the transmission/reception apparatus 30 communicating with the mobile appliance 5. Alternatively or else in addition, the mobile appliance 5 can transmit at least one location coordinate together with the destination call T1 or else identification code T1', which location coordinate is assigned to a call input floor. The location coordinate can be picked up by at least one sensor in the mobile appliance 5, such as a known Global Positioning System (GPS) or else a barometric altimeter.

Figure 5:
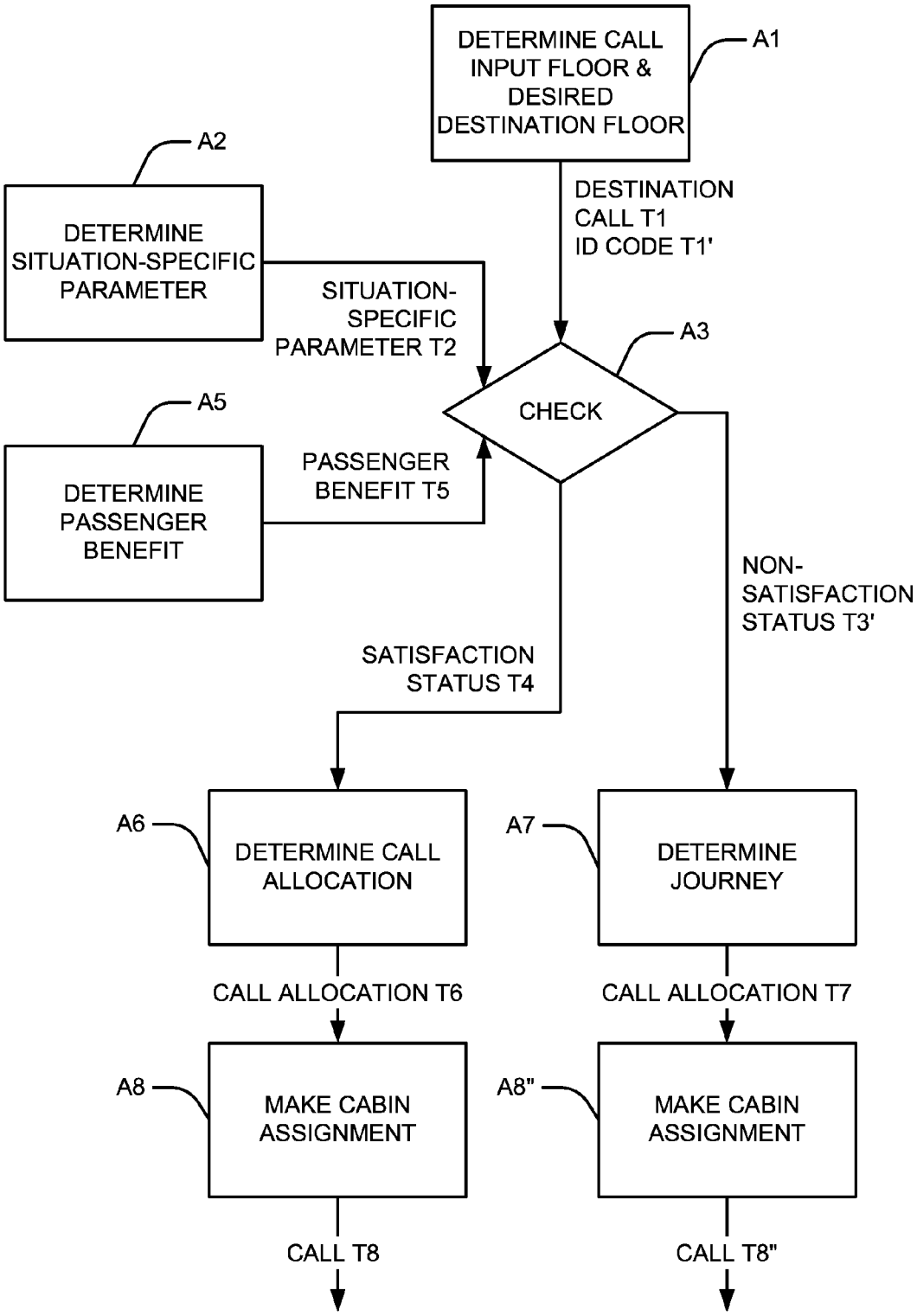
FIG. 5 shows a flowchart of a portion of a first exemplary embodiment of the method for controlling an elevator system as shown in FIGS. 1 to 4.
Figure 6:
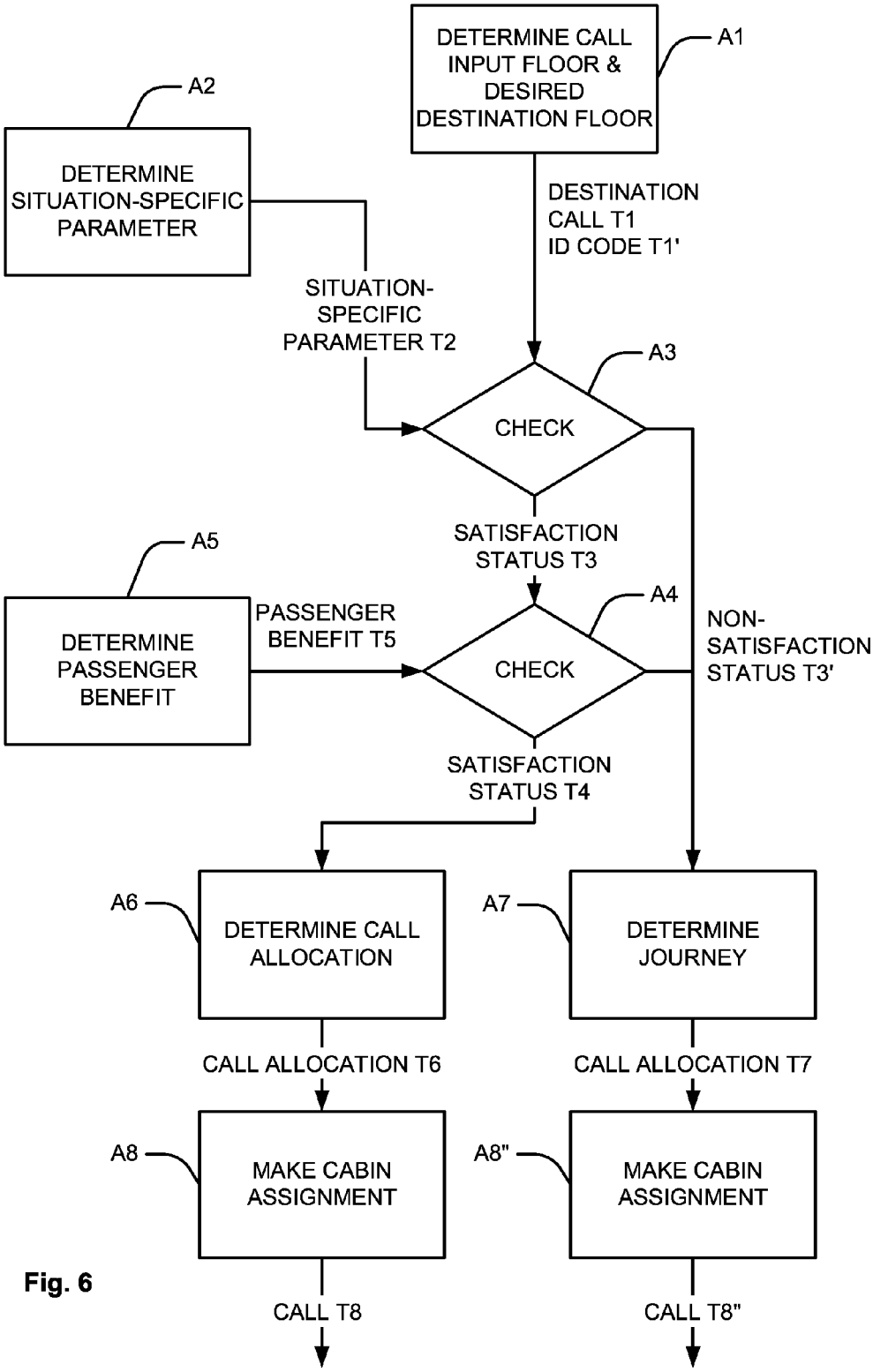
FIG. 6 shows a flowchart of a portion of a second exemplary embodiment of the method for controlling an elevator system as shown in FIGS. 1 to 4.
Figure 7:
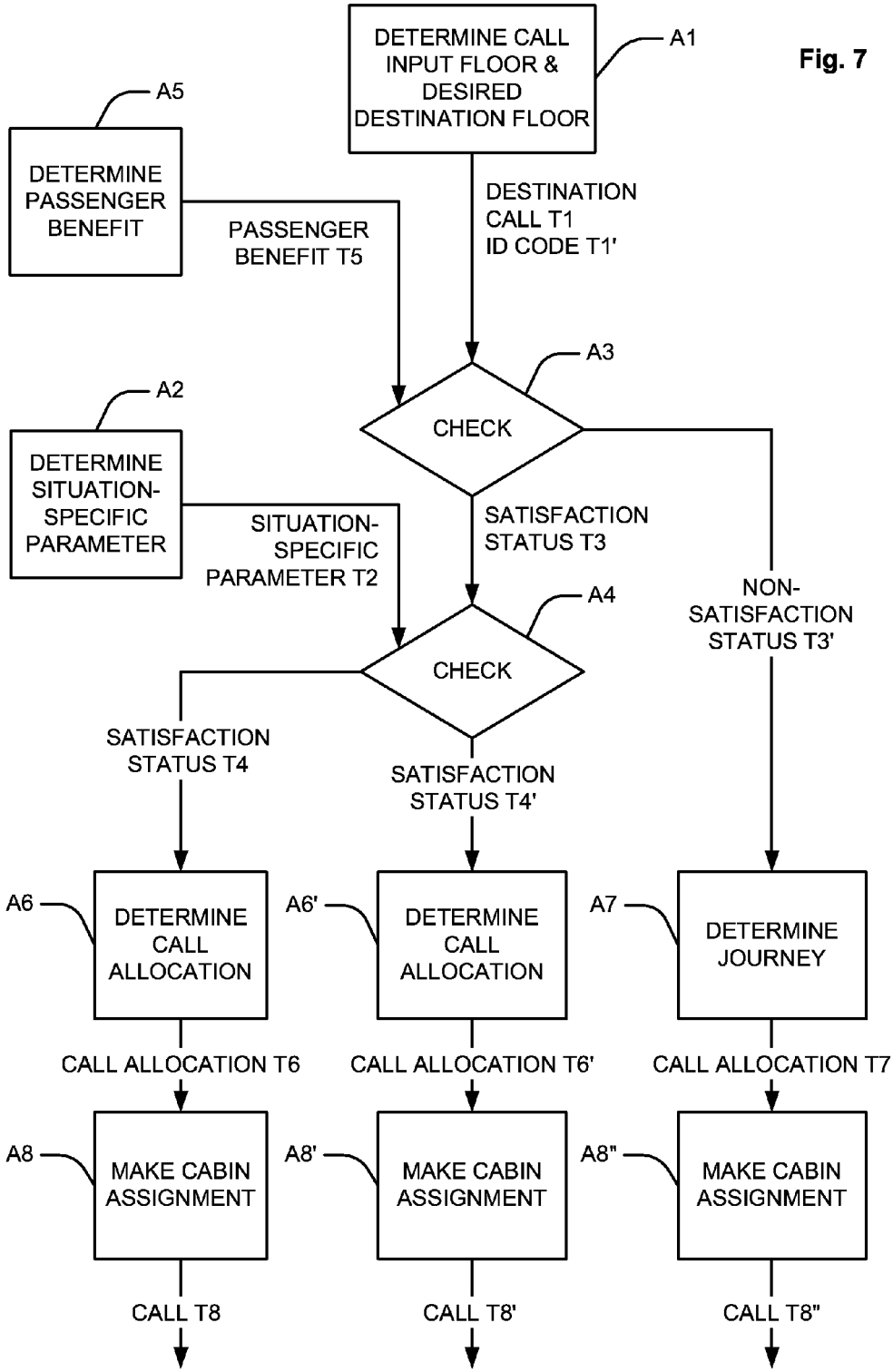
FIG. 7 shows a flowchart of a portion of a third exemplary embodiment of the method for controlling an elevator system as shown in FIGS. 1 to 4.

The destination call controller 3, 3', 3" operates on the basis of at least one optimization process for ascertaining at least one favorable call allocation for a destination call. FIGS. 5 to 7 show flowcharts for five exemplary embodiments of the method for controlling an elevator system 10. The individual method steps are described in more detail below:

In a method step A1, a call input floor and a desired destination floor are determined for a destination call T1 or else an identification code T1'. The call input floor is the floor S1 to S9 which holds the call input apparatus 4 in the building or else the floor S1 to S9 from which the mobile appliance 5 communicates with the destination call controller 3, 3', 3". The destination floor is the destination floor which is desired by the passenger. The pairing consisting of the call input floor and the destination floor which is desired by the passenger is stored for each destination call in the computer-readable data memory of the destination call controller 3, 3', 3" and can be retrieved therefrom.

In a method step A2, at least one instantaneous value for a situation-specific parameter T2, such as an instantaneous volume of traffic in the elevator system 10, an instantaneous volume of traffic in an elevator cabin 1, 1', 1", an instantaneous time of day, an instantaneous day of the week, an instantaneous route distance for a passenger to an elevator cabin 1, 1', 1", etc., is picked up. Particularly at peak times, for example, an arrival rate for passengers can change severely and reach the capacity limit for the elevator system 10 at short intervals of time. By way of example, a situation-specific parameter T2 specifies an instantaneous volume of traffic for the elevator system 10 or else elevator cabin 1, 1', 1" as a percentage. It can also be desirable for an elevator cabin 1, 1', 1" to be provided on the departure floor only at the time at which the passenger who needs to be moved in the building on a basis of destination call T1 or else identification code T1' has actually reached the elevator cabin 1, 1', 1". That is to say that the actual assignment of the elevator cabin 1, 1', 1" is effected shortly before the passenger reaches the elevator system 10 on the departure floor or else change floor. By way of example, a further situation-specific parameter T2 specifies an instantaneous route distance for a passenger to the elevator cabin 1, 1', 1" on the departure floor or else change floor in meters. Method step A2 is updated, for example the situation-specific parameter T2 is updated every two seconds, possibly every second. The situation-specific parameter T2 is stored in the computer-readable data memory of the elevator controller 2, 2', 2" or else of the destination call controller 3, 3', 3" and can be retrieved therefrom. By way of example, an instantaneous time of day or else an instantaneous day of the week describes at least one peak time with a high volume of traffic for the elevator system 10. Such a peak time may be on weekdays in the morning between 7 o'clock and 9 o'clock, in the middle of the day between 11 o'clock and 1 o'clock and in the evening between 4 o'clock and 6 o'clock.

In a method step A5, at least one passenger benefit T5, such as waiting time, destination time, number of changes of direction, number of changes by the passenger, number of intermediate stops, elevator cabin passenger number, route distance, route passenger number, elevator cabin equipment, etc. is produced. Method step A5 can take place in advance when the elevator system 10 is started up, and is permanently updated. The passenger benefit may be differentiated on an individual basis. By way of example, a distinction can be drawn between passengers who are a very important person (VIP) or an important person (IP) or a standard person (SP). For an average building with around 30 floors, the passenger benefit T5 is defined as follows:

The waiting time is the time between destination call input and opening of the floor door when the elevator cabin 1, 1', 1" arrives on the departure floor. A VIP waiting time is fifteen seconds, an IP waiting time is 30 seconds and an SP waiting time is 45 seconds.

The destination time is the time between destination call input and opening of the floor door when the elevator cabin 1, 1', 1" arrives on the arrival floor. A VIP destination time is 45 seconds. An IP destination time is 90 seconds. An SP destination time is 150 seconds.

The number of changes of direction is the number of changes of direction by the elevator cabin 1, 1', 1" during the journey from the departure floor to the arrival floor. A VIP number of changes of direction is zero. An IP number of changes of direction is zero. An SP number of changes of direction is one.

The number of changes by the passenger is the number of changes between elevator cabins 1, 1', 1" in order to be moved from the departure floor to the arrival floor. A VIP number of changes by the passenger is zero. An IP number of changes by the passenger is one. An SP number of changes by the passenger is two.

The number of intermediate stops is the number of floor stops for the elevator cabin 1, 1', 1" during the journey from the departure floor to the arrival floor. A VIP number of intermediate stops is zero, which corresponds to a direct journey. A IP number of intermediate stops is three. A SP number of intermediate stops is five.

The elevator cabin passenger is the maximum permissible number of passengers in the elevator cabin 1, 1', 1" during the journey from the departure floor to the arrival floor. A VIP elevator cabin passenger number is 20% of the transportation capacity of the elevator cabin 1, 1', 1". An IP elevator cabin passenger number is 80% of the transportation capacity of the elevator cabin 1, 1', 1". An SP elevator cabin passenger number is 100% of the transportation capacity of the elevator cabin 1, 1', 1".

The route distance is the distance from the location coordinate of the call input apparatus 4 or else of the mobile appliance 5 to the elevator system 10 and from there to a journey destination. The journey destination may be predefined, for example a particular building door 9 on the arrival floor. The predefined journey destination is stored in the passenger profile together with the destination call and the passenger benefit T5 and can be read or else transmitted in exactly the same way as these. Alternatively, the journey destination can be input on the input appliance 41 of the call input apparatus 4 or else on the input/output appliance 51, 52 of the mobile appliance 5 and can be transmitted to the destination call controller 3, 3', 3" in exactly the same way as an input destination call T1 or else a read identification code T1'. A VIP route distance is as short as possible both on the call input floor and on the arrival floor. An IP route distance is as short as possible only on the call input floor or else on the arrival floor. An SP route distance is not optimized for distance in this manner.

The route passenger number is the number of further passengers on the route from the location coordinate of the call input apparatus 4 or else of the mobile appliance 5 to the elevator system 10 and from there to the journey destination. To this end, the destination call controller 3, 3', 3" has available frequencies of use on the routes in the building. The frequencies of use may vary depending on the time of day and the day of the week or else holiday. A VIP route passenger number is as low as possible both on the call input floor and on the arrival floor. An IP route passenger number is as low as possible only on the call input floor or else on the arrival floor. An SP route passenger number is not optimized for frequency of use in this manner.

The elevator cabin equipment specifies the equipment of an elevator cabin 1, 1', 1" during the journey from the departure floor to the arrival floor. A VIP elevator cabin equipment defines a particular elevator cabin 1, 1', 1" with luxurious or else original equipment. Thus, a VIP elevator cabin equipment may be a panorama elevator cabin or else an elevator cabin 1, 1', 1" with multimedia equipment such as audio, video, etc., or else an elevator cabin 1, 1', 1" which provides a particularly large amount of space or else an elevator cabin 1, 1', 1" which travels particularly quickly or else an elevator cabin 1, 1', 1" having a particularly wide or large floor door or else an elevator cabin 1, 1', 1" having a particularly quickly closing/opening floor door or else an elevator cabin 1, 1', 1" having an additional authentication apparatus such as an iris scanner, fingerprint scanner, body scanner, etc. By way of example, an IP elevator cabin equipment defines an elevator cabin 1, 1', 1" which stops with particular precision on floor S1 to S9 or else an elevator cabin 1, 1', 1" which travels with particularly little noise or else an elevator cabin 1, 1', 1" with a particularly large number of floor doors. An SP elevator cabin equipment defines an elevator cabin 1, 1', 1" which is equipped in line with normal expectations.

The described three-leveled differentiation of the passenger benefit T5 is exemplary and may naturally also be implemented with fewer than three levels, for example two levels, or else with more than three levels, for example five levels, or else continuously, for example with division into periods of one second. Thus, the number of changes of direction can be varied on three levels between a first number of changes of direction zero and a second number of changes of direction two. The elevator cabin passenger number can thus be varied on five levels in five 20% sections. The waiting time or else the destination time can thus be varied in steps of one second between a minimum and a maximum.

The passenger benefit T5 is stored in at least one passenger profile and may be stored in a computer-readable data memory in the destination call controller 3, 3', 3" or else in the destination call apparatus 4 or else in the mobile appliance 5. By way of example, the passenger benefit T5 is read during the call input for a destination call and is transmitted together with the destination call from the call input apparatus 4 or else from the mobile appliance 5 to the destination call controller 3, 3', 3". It is particularly advantageous to store the passenger profile in the computer-readable data memory in the destination call controller 3, 3', 3" and to associate it with an identification code T1'. Alternatively, the input appliance 41 of the call input apparatus 4 or else the input/output appliance 51 of the mobile appliance 5 can also be used to input at least one passenger code for the destination call T1, with a passenger profile being assigned to said input passenger code. There therefore exists an associated passenger profile for a passenger with identification code T1' or else passenger code for a destination call T1, which passenger profile has at least one predefined destination call T1 and at least one passenger benefit T5.

The passenger profile is produced by at least one building manager and is customized on a passenger-specific basis. It is the building manager who classifies the passengers into VIP, IP and SP. The passenger or else the destination call controller 3, 3', 3" can alter a passenger benefit T5. A plurality of passenger benefits T5 can be weighted, i.e. an individual passenger benefit T5 can possibly be put into at least one ranking. By way of example, the building manager or else the passenger stipulates a weighting for a plurality of passenger benefits T5 in the passenger profile. By way of example, the first rank contains a passenger benefit T5 'low number of departure floor changes', the second rank contains a passenger benefit T5 'low number of arrival floors', and the third rank contains a passenger benefit T5 'low number of changes by the passenger'. Naturally, this weighting can also be changed. With knowledge of the present disclosure, a person skilled in the art can provide further passenger benefits.

In at least one method step A3, A4, a destination call T1 or else an identification code T1' is checked to determine whether at least one situation-specific parameter T2 or else at least one passenger benefit T5 is satisfied. In this regard, FIGS. 5 to 7 show three variants of the checks. According to FIG. 5, a method step A3 involves at least one situation-specific parameter T2 and/or at least one passenger benefit T5 being checked; according to FIG. 6, a method step A3 first of all involves at least one situation-specific parameter T2 being checked, and then a method step A4 involves at least one passenger benefit T5 being checked; according to FIG. 7, a method step A3 first of all involves at least one passenger benefit T5 being checked, and then a method step A4 involves at least one situation-specific parameter T2 being checked. Hence, FIG. 5 involves a check being performed in a method step A3, and FIGS. 6 and 7 involve a check being performed in two method steps A3, A4. Method steps A3, A4 may coincide in time or may occur at separate times.

Method step A3 as shown in FIG. 5 involves at least one situation-specific parameter T2 or at least one passenger benefit T5 being checked. The check on the situation-specific parameter T2 involves an instantaneous value for the situation-specific parameter T2 being compared with at least one freely settable saturation range for the situation-specific parameter T2. The saturation range may lie between 50% and 100%, possibly 66% and 100%, possibly 80% and 100%, of the capacity limit of the elevator system 10 or elevator cabin 1, 1', 1". If the instantaneous value of the situation-specific parameter T2 for the passenger benefit T5 that is satisfied with a satisfaction status T3 is outside of the saturation range, the situation-specific parameter T2 is satisfied. The check on a passenger benefit T5 involves a passenger profile associated with an identification code T1' or else passenger code for a destination call T1 being read, which passenger profile has at least passenger benefit T5. If both a situation-specific parameter T2 is satisfied and a passenger benefit T5 exists then at least one situation-compliant satisfaction status T4 is set; if either a situation-specific parameter T2 is not satisfied or a passenger benefit T5 does not exist then at least one non-satisfaction status T3' is set.

In method step A3 as shown in FIG. 6, the check on the situation-specific parameter T2 involves an instantaneous value for the situation-specific parameter T2 being compared with at least one freely settable saturation range for the situation-specific parameter T2. The saturation range may lie between 50% and 100%, preferably 66% and 100%, preferably 80% and 100%, of the capacity limit of the elevator system 10 or else elevator cabin 1, 1', 1". If the instantaneous value of the situation-specific parameter T2 is outside of the saturation range then the situation-specific parameter T2 is satisfied, and at least one satisfaction status T3 is then set. If the instantaneous value of the situation-specific parameter T2 is inside the saturation range then the situation-specific parameter T2 is not satisfied, and at least one non-satisfaction status T3' is then set.

Next, in method step A4 as shown in FIG. 6, the check on a passenger benefit T5 involves a passenger profile associated with an identification code T1' or else passenger code for a destination call T1 being read, which passenger profile has at least one passenger benefit T5. If at least one passenger benefit T5 also exists for a situation-specific parameter T2 which is satisfied with a satisfaction status T3 then at least one situation-compliant satisfaction status T4 is set; if no passenger benefit T5 exists for a situation-specific parameter T2 which is satisfied with a satisfaction status T3 then at least one non-satisfaction status T3' is set.

In method step A3 as shown in FIG. 7, the check on a passenger benefit T5 involves a passenger profile associated with an identification code T1' or a passenger code for an destination call T1 being read, which passenger profile has at least one passenger benefit T5. If a passenger benefit T5 exists then at least one satisfaction status T3 is set; if no passenger benefit T5 exists then at least one non-satisfaction status T3' is set.

Next, in method step A4 as shown in FIG. 7, the check on a situation-specific parameter T2 involves an instantaneous value for the situation-specific parameter T2 being compared with at least one freely settable saturation range for the situation-specific parameter T2. The saturation range may lie between 50% and 100%, possibly 66% and 100%, possibly 80% and 100%, of the capacity limit of the elevator system 10 or else elevator cabin 1, 1', 1". If the instantaneous value of the situation-specific parameter T2 for the passenger benefit T5, which is satisfied with a satisfaction status T3, is outside of the saturation range, then the situation-specific parameter T2 is satisfied, and at least one situation-compliant satisfaction status T4 is then set. If the instantaneous value of the situation-specific parameter T2 for the passenger benefit T5 which is satisfied with a satisfaction status T3 is inside the saturation range then the situation-specific parameter T2 is not satisfied, and at least one passenger-beneficial satisfaction status T4' is then set.

With knowledge of the present disclosure, the variants shown for the checks can naturally be combined with one another. Thus, method step A3 as shown in FIG. 5 can also involve a distinction being drawn between a non-satisfaction status T3' and a passenger-beneficial satisfaction status T4' as shown in FIG. 7.

In a method step A6, for the situation-compliant satisfaction status T4 that has been set, at least one situation-compliant call allocation T6 is ascertained for a journey with a floor difference of zero.

In a method step A6', for the passenger-beneficial satisfaction status T4' which has been set, at least one passenger-beneficial call allocation T6' is ascertained for a journey with passenger benefit T5.

The situation-compliant call allocation T6 or the passenger-beneficial call allocation T6' is output with at least one multimedia information item on the output appliance 42 of the call input apparatus 4 or on the input/output appliance 51, 52 of the mobile appliance 5.

A situation-specific parameter T2 or a passenger benefit T5 is output as a multimedia information item to the passenger who is using the call input apparatus 4 to input a destination call T1 and a passenger code or else to send an identification code T1'. By way of example, a number of changes of direction or a destination time for the conveyance by the elevator cabin 1, 1', 1" is output to the passenger as a passenger benefit T5. The multimedia information may contain written text, a graphic or a spoken word or a spoken sentence and a video picture. The destination time can thus be output as a passing time of day. A situation-specific parameter T2 'current route distance' is output to the passenger as a multimedia information item. The current route distance can be provided as a constantly updated distance statement, for example the remaining distance from the current location coordinate to the elevator shaft S0, S0', S0" of the elevator cabin 1, 1', 1" is output in meters.

In a method step A7, at least one journey with a floor difference other than zero is ascertained for the set non-satisfaction status T3'. To this end, a most favorable call allocation T7 with the shortest possible waiting time or else the shortest possible destination time is ascertained. The ascertained most favorable call allocation T7 is stored in the computer-readable data memory of the destination call controller 3, 3', 3" and can be retrieved therefrom. By way of example, the ascertained most favorable call allocation T7 is entered in a table, with the ascertained most favorable call allocation T7 conveyed being the call input floor, the destination floor desired by the passenger, the departure floor, the arrival floor, a waiting time, a destination time, at least one operating cost, and at least one elevator cabin 1, 1', 1".

In a method step A8, the situation-compliant call allocation T6 is assigned to at least one elevator cabin 1, 1', 1". To this end, the destination call controller 3, 3', 3" transmits at least one signal T8' for a departure call and for a destination call to the elevator controller 2, 2', 2" for the assigned elevator cabin 1, 1', 1".

In a method step A8', the passenger-beneficial call allocation T6' is assigned to at least one elevator cabin 1, 1', 1". To this end, the destination call controller 3, 3', 3" transmits at least one signal T8' for a departure call and for a destination call to the elevator controller 2, 2', 2" for the assigned elevator cabin 1, 1', 1".

In a method step A8", the most favorable call allocation T7 is assigned to at least one elevator cabin 1, 1', 1". To this end, the destination call controller 3, 3', 3" transmits at least one signal T8" for a departure call and for a destination call to the elevator controller 2, 2', 2" for the assigned elevator cabin 1, 1', 1".

Within the context of the present disclosure, the conjunction "or else" is used to mean "and/or".

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

The invention claimed is:

1. An elevator control method, comprising:

receiving at least one destination call, the destination call having been input on a call input floor and indicating a destination floor;

determining a passenger benefit corresponding to the destination call in one of at least three different classes of passenger;

determining that a situation-specific parameter corresponding to the passenger benefit is satisfied; and based on the received at least one destination call and based on the determination for the situation-specific parameter, determining at least one elevator journey using at least one of two or more elevator cabins disposed in an elevator shaft, the determined at least one elevator journey indicating at least one of a departure floor equal to the call input floor and an arrival floor equal to the destination floor.

2. The elevator control method of claim 1, the determined at least one elevator journey indicating the departure floor equal to the call input floor.

3. The elevator control method of claim 1, the determined at least one elevator journey indicating the arrival floor equal to the destination floor.

4. The elevator control method of claim 1, the determined at least one elevator journey indicating the departure floor equal to the call input floor and the arrival floor equal to the destination floor.

5. The elevator control method of claim 1, the situation-specific parameter comprising an indication of a current traffic volume in an elevator system.

6. The elevator control method of claim 1, the situation-specific parameter comprising an indication of a current traffic volume of at least one of the two or more elevator cabins.

7. The elevator control method of claim 1, the situation-specific parameter comprising a time of day.

8. The elevator control method of claim 1, the situation-specific parameter comprising a day of the week.

9. The elevator control method of claim 1, further comprising determining that at least one passenger benefit exists and determining a passenger-beneficial call allocation for the determined at least one elevator journey.

10. An elevator control method, comprising:

receiving a first destination call, the first destination call comprising a first call input floor and a first destination floor;

determining, in a first determination, that a time parameter or a traffic parameter is not satisfied;

based on the received first destination call and the first determination, generating a first elevator journey for one of two or more elevator cabins disposed in an elevator shaft, the first elevator journey indicating a first arrival floor different than the first destination floor;

receiving a second destination call, the second destination call comprising a second call input floor and a second destination floor;

determining, in a second determination, that the time parameter or the traffic parameter is satisfied; and based on the received second destination call and the second determination, generating a second elevator journey for the one of the two or more elevator cabins disposed in the elevator shaft, the second elevator journey indicating a second start floor the same as the second call input floor or a second arrival floor the same as the second destination floor.

11. The elevator control method of claim 10, the time parameter being not satisfied in the first determination and being satisfied in the second determination.

12. The elevator control method of claim 10, the traffic parameter being not satisfied in the first determination and being satisfied in the second determination.

13. An elevator installation, comprising:

a plurality of elevator cabins disposed in an elevator shaft;

at least one call input apparatus disposed at a call input floor; and at least one destination call controller coupled to the at least one call input apparatus, the at least one destination call controller being configured to receive at least one destination call and a passenger benefit corresponding to the destination call in one of at least three different classes of passenger, the passenger benefit corresponding to the destination call, the destination call indicating the call input floor and a destination floor, the at least one destination call controller being further configured to determine that a situation-specific parameter corresponding to the passenger benefit is satisfied and to determine, based on the determination and based on the at least one destination call, at least one elevator journey, the at least one elevator journey indicating at least one of a departure floor equal to the call input floor and an arrival floor equal to the destination floor.

14. The elevator installation of claim 13, the at least one elevator journey indicating the departure floor equal to the call input floor and the arrival floor equal to the destination floor.

15. The elevator installation of claim 13, the situation-specific parameter comprising a route distance for a passenger to at least one of the two or more elevator cabins.

16. An elevator control component, comprising:

a processor; and a computer-readable data memory, the computer-readable data memory storing instructions which, when executed by the processor, cause the processor to perform a method, the method comprising, receiving a first destination call, the first destination call comprising a first call input floor and a first destination floor, determining, in a first determination, that a time parameter or a traffic parameter is not satisfied, based on the received first destination call and the first determination, generating a first elevator journey for one of two or more elevator cabins disposed in an elevator shaft, the first elevator journey indicating a first arrival floor different than the first destination floor, receiving a second destination call, the second destination call comprising a second call input floor and a second destination floor, determining, in a second determination, that the time parameter or the traffic parameter is satisfied, and based on the received second destination call and the second determination, generating a second elevator journey for the one of the two or more elevator cabins disposed in the elevator shaft, the second elevator journey indicating a second start floor the same as the second call input floor or a second arrival floor the same as the second destination floor.

17. The elevator control component of claim 16, the second elevator journey indicating the second departure floor equal to the second call input floor and the second arrival floor equal to the second destination floor.

18. The elevator control component of claim 16, the two or more elevator cabins comprising a double cabin.

19. One or more computer-readable data memories having encoded thereon instructions which, when executed by a processor, cause the processor to perform a method, the method comprising:

receiving at least one destination call and a passenger benefit corresponding to the destination call in one of at least three different classes of passenger, the passenger benefit corresponding to the destination call, the destination call having been input on a call input floor and indicating a destination floor;

determining that a situation-specific parameter corresponding to the passenger benefit is satisfied; and based on the received destination call and based on the determination for the situation-specific parameter, determining at least one elevator journey using at least one of two or more elevator cabins disposed in an elevator shaft, the determined at least one elevator journey indicating at least one of a departure floor equal to the call input floor and an arrival floor equal to the destination floor.

20. The one or more computer-readable data memories of claim 19, the two or more elevator cabins comprising a double cabin.

* * * * *